US007097893B2

(12) United States Patent
McCarthy et al.

(10) Patent No.: US 7,097,893 B2
(45) Date of Patent: Aug. 29, 2006

(54) VERSATILE PRINTABLE SHEET FOR FORMING JEWEL CASE INSERTS AND BOOKLETS

(75) Inventors: Brian McCarthy, Anaheim, CA (US); Heather Anne Gareis, Los Angeles, CA (US); Mark R. Mannon, Newport Beach, CA (US)

(73) Assignee: Avery Dennison Corporation, Pasadena, CA (US)

( * ) Notice: Subject to any disclaimer, the term of this patent is extended or adjusted under 35 U.S.C. 154(b) by 170 days.

(21) Appl. No.: 10/631,617

(22) Filed: Jul. 30, 2003

(65) Prior Publication Data

US 2004/0071922 A1 Apr. 15, 2004

Related U.S. Application Data

(60) Provisional application No. 60/400,929, filed on Aug. 1, 2002.

(51) Int. Cl.
*G09F 3/02* (2006.01)

(52) U.S. Cl. ..... 428/43; 347/106; 347/262; 206/308.1; 206/387.13; 428/131; 428/32.1

(58) Field of Classification Search ..... 428/43, 428/131, 32.1; 206/308.1, 387.13; 347/106, 347/262

See application file for complete search history.

(56) References Cited

U.S. PATENT DOCUMENTS

| | | | | |
|---|---|---|---|---|
| 5,749,463 | A * | 5/1998 | Collins | 206/308.1 |
| 5,789,051 | A | 8/1998 | Tracy | |
| 6,155,026 | A | 12/2000 | Tracy | |
| 6,481,572 | B1 * | 11/2002 | Wien et al. | 206/232 |
| 6,673,408 | B1 * | 1/2004 | Roth | 428/40.1 |
| 2002/0197434 | A1 * | 12/2002 | Rosenbaum et al. | 428/41.8 |

* cited by examiner

*Primary Examiner*—William P. Watkins, III
(74) *Attorney, Agent, or Firm*—Scott R. Hansen; Fulwider Patton LLP

(57) ABSTRACT

A single sheet has multiple separation lines arranged such that the sheet can be printed on by a standard printer such as a personal computer printer, and the sheet may thereafter be separated and/or folded in any one of three different configurations to form different possible compact disc jewel case inserts including both face labels and spine labels. One embodiment is of a sheet having at least four longitudinal lines of weakness extending across at least a major portion of the length of the sheet, and at least three latitudinal lines of weakness extending across a major portion of the width of the sheet, with at least one longitudinal line of weakness being a fold about which at least one portion is folded.

10 Claims, 5 Drawing Sheets

VERSATILE PRINTABLE SHEET FOR FORMING JEWEL CASE INSERTS AND BOOKLETS

CROSS REFERENCE TO RELATED APPLICATIONS

This application claims the benefit of U.S. Provisional Application No. 60/400,929, filed Aug. 1, 2002.

BACKGROUND OF THE INVENTION

As well known, there are different configurations of cases for holding and storing compact discs. One type of case is a "standard" sized case into which can be inserted a booklet of four or more pages, an insert for the front cover that is only a single sheet, and/or a separate spine portion to label the spine of the CD case.

Another type of compact disc case is the so-called "slim line" case, which also accepts booklets and/or inserts for labeling the front of the case.

Attempts have been made to create perforated sheets that can be printed in a local printer, such as an ink jet printer and/or a laser jet printer. However, as shown in U.S. Pat. Nos. 5,789,051 and 6,155,026, the prior art requires at least two different kinds of sheets in order to print an insert or a booklet. This arrangement is costly to the end-user, in that they need to buy a supply of both types of sheets in order to perform different functions.

Consequently there is a need for a single, versatile sheet onto which a user may selectively print a booklet, an insert, or an insert having a spine portion for insertion into a slim line case.

DETAILED DESCRIPTION OF THE INVENTION

Figure 1:
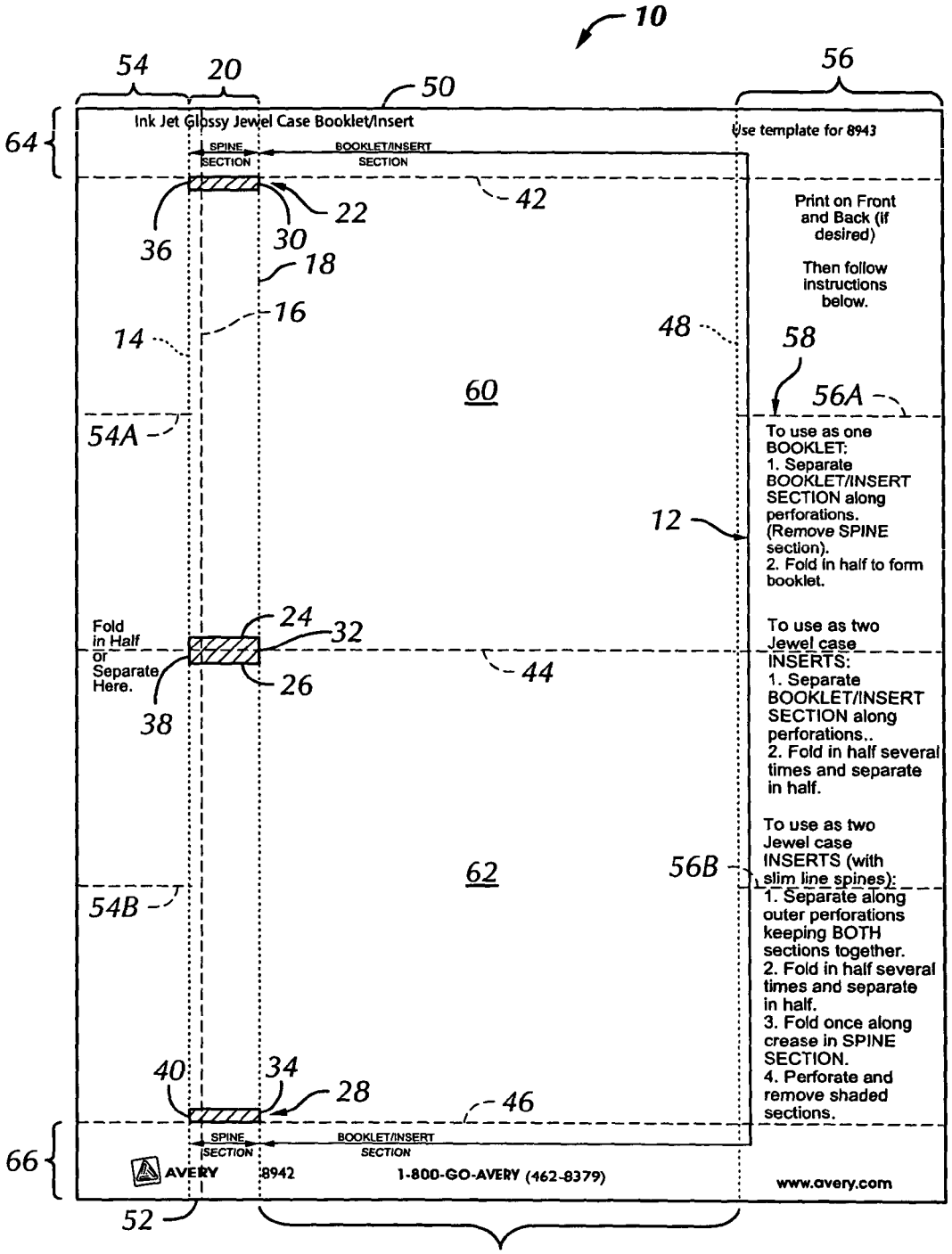
FIG. 1 is a front view of the versatile sheet onto which a user may selectively print a booklet for insertion into a compact disc case, an insert for insertion into the front or back of a compact disc case, or an insert having a spine for use in a slim line compact disc case.

FIG. 1 illustrates a sheet 10 from which a CD booklet, cd insert, or cd insert with a spine section may be printed and formed. The sheet includes instructions printed on a portion 12 of the sheet 10. The instructions explain how to use the sheet to form a booklet, to form an insert or to form an insert with a spine section. The instructions in the particular embodiment of FIG. 1 are printed on a right hand margin of the sheet. However, the instructions can be printed in the left hand margin of the sheet or, in some cases even the top and the bottom of the sheet. Consequently, the instructions may be printed on any available portion of the sheet, other than the portion of the sheet to be formed into the booklet, or inserts.

The sheet includes four longitudinal lines of weakness. Starting from the left hand side of FIG. 1, there is one longitudinal line of weakness 14 extending the full length of the sheet. The line of weakness 14 as shown in FIG. 1 is a line of microperforations. However, it should be understood that the line of weakness 14 can be formed in alternative ways, such as regular perforations, a cut and die arrangement, or a deep score line. However, it is presently preferred that line 14 be a line of microperforations.

Moving to the right in FIG. 1, a second line of weakness 16 is formed by a cut and-tie arrangement. Line of weakness 18 is formed with microperforations, and extends the full length of the sheet. Together the lines of weakness 14, 16 and 18 define a spine portion 20 which will remain attached to the insert after printing, when the insert is an insert having a spine portion. It should be understood that the microperforations of line 14, the cut-and-tie arrangement of line 16 and the microperforations defining line 18 may be other types of lines of weakness, such as regular perforations, cut-and-tie arrangements, microperforations, a slit and tie arrangement, or, in some cases, deep score lines, or a combination thereof.

Spine section 20 also includes removable portions 22, 24, 26 and 28. Preferably, the upper and lower edges of these sections are formed with microperforations. Optionally, certain portions of the removable sections 22, 24, 26 and/or 28 may be formed with die cuts. In particular, die cuts may be used at 30, 32 and 34. Optionally, die cuts may also be used at 36, 38 and 40, although it is presently preferred to use microperforations at 36, 38 and 40.

This sheet further comprises latitudinal lines of weakness 42, 44 and 46. It is presently preferred that line of weakness 42 and 46 be formed from microperforations, while the central line of weakness 44 is defined by a cut-and-tie arrangement. However, the lines of weakness 42, 44 and 46 may optionally be made from other forms of lines of weakness, as listed above. A fourth longitudinal line of weakness 48 is present on the right had portion of FIG. 1. The line of weakness 48 extends the full length of the sheet. It should be understood that the lines of weakness 14, 16, 18 and 48 preferably extend the full length of the sheet, although as an alternative, line of weakness 14, 16, 18 and 48 can extend a distance less than the full length of the sheet, such as, for example, between lines 42 and 46, and not all the way to the edges 50 and 52 of the sheet 10. Similarly, the latitudinal lines of weakness 42, 44 and 46 do not necessarily need to extend the full width of the sheet, but may extend, for example, only between latitudinal lines of weakness 48 and 14.

It shall be noted that the terms "latitudinal" and "longitudinal" refer to the lines that are illustrated in FIG. 1. However, the pattern of FIG. 1 may be formed on a sheet such that "latitudinal" and "longitudinal" are reversed. Consequently, the invention is not limited to the exact pattern or sheet orientation that is illustrated in FIG. 1.

The area 54 is a removable left hand margin of the sheet in FIG. 1. The area 56 is a removable right hand margin of the sheet 10 in FIG. 1. It is noted that in the removable right hand section 56, there are instructions for use 58 printed to instruct the user how to print and use the sheet. These instructions may include specific instructions as to how to form a booklet, an insert, and/or an insert with spines for a slim line compact disc case.

Figure 3:
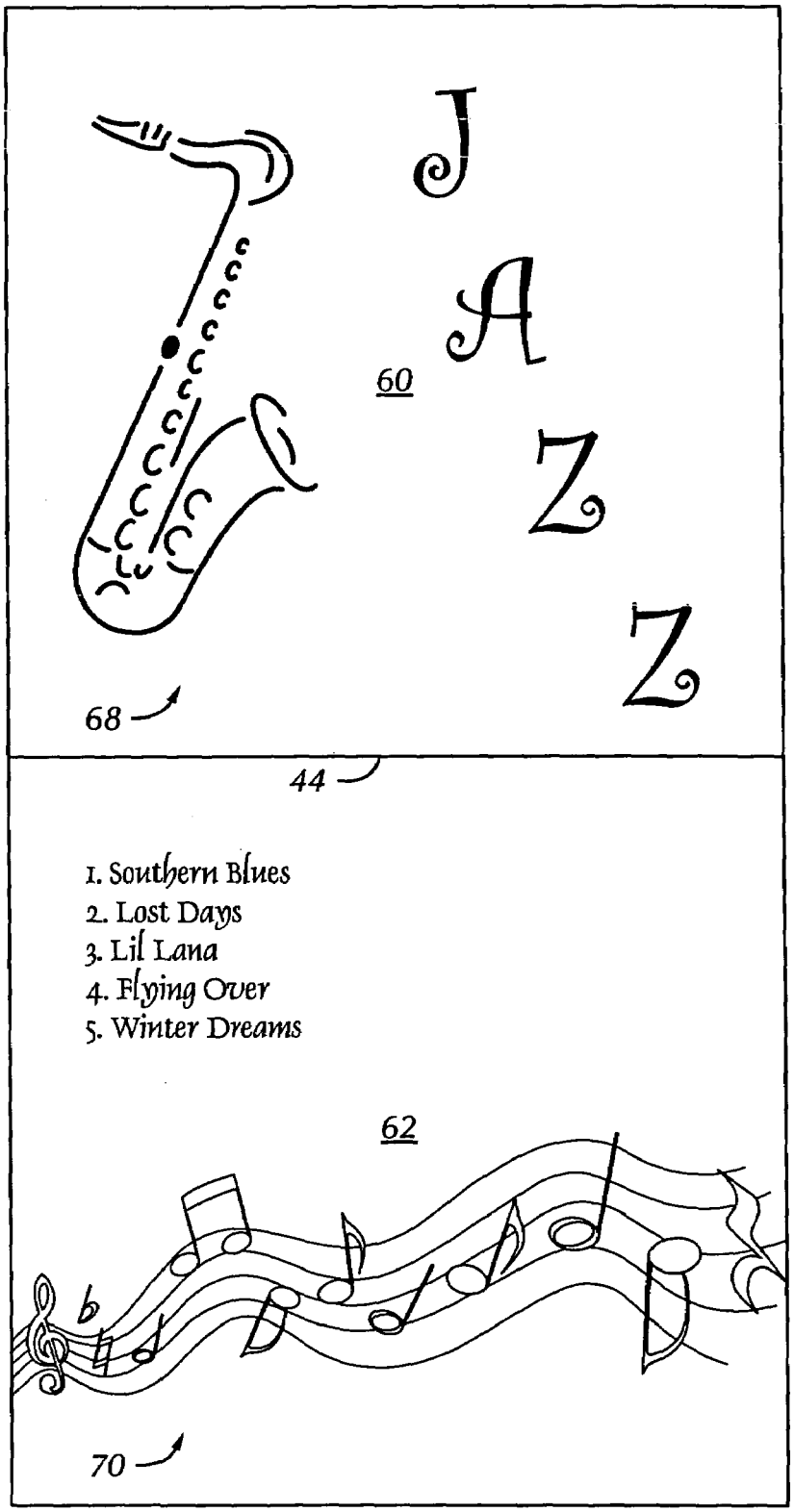
FIG. 3 illustrates the booklet that has been separated from the sheet of either FIG. 1 or 2, wherein the booklet has been printed in a laser, ink jet, or other home/office printer, FIG. 3 showing only the front of the booklet, whereas the back of the booklet may also be printed such that there is printing on three or four pages of the booklet.
Figure 4A:
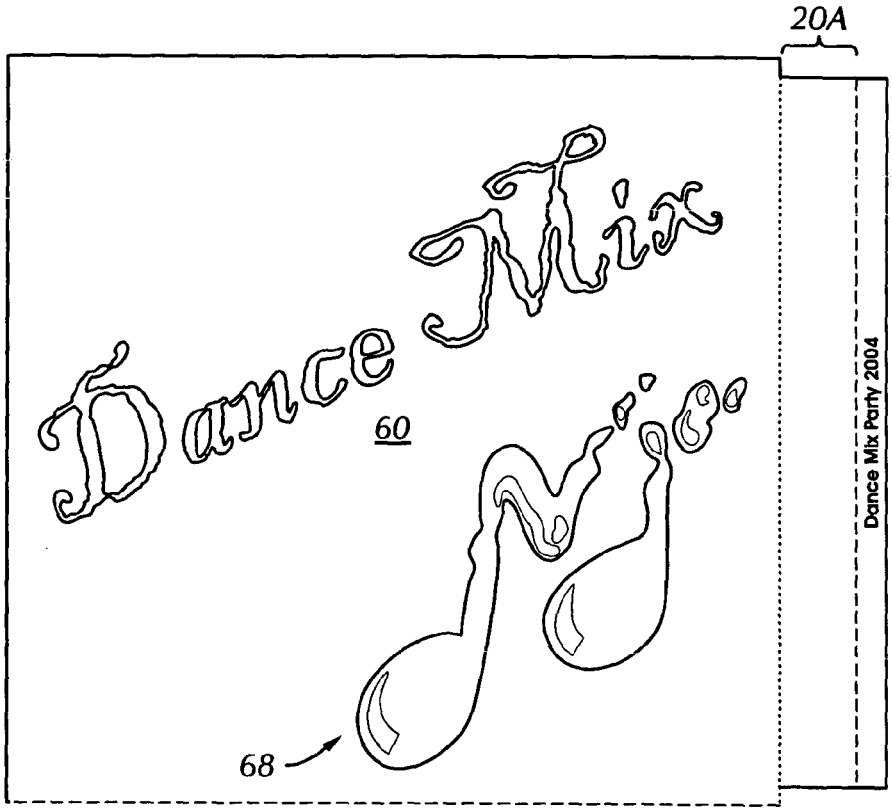
FIGS. 4A and 4B illustrates two CD case inserts for insertion into a slim line compact disc case, the inserts having a spine portion to label the spine of the compact disc case, as well as the front of the case.
Figure 4B:
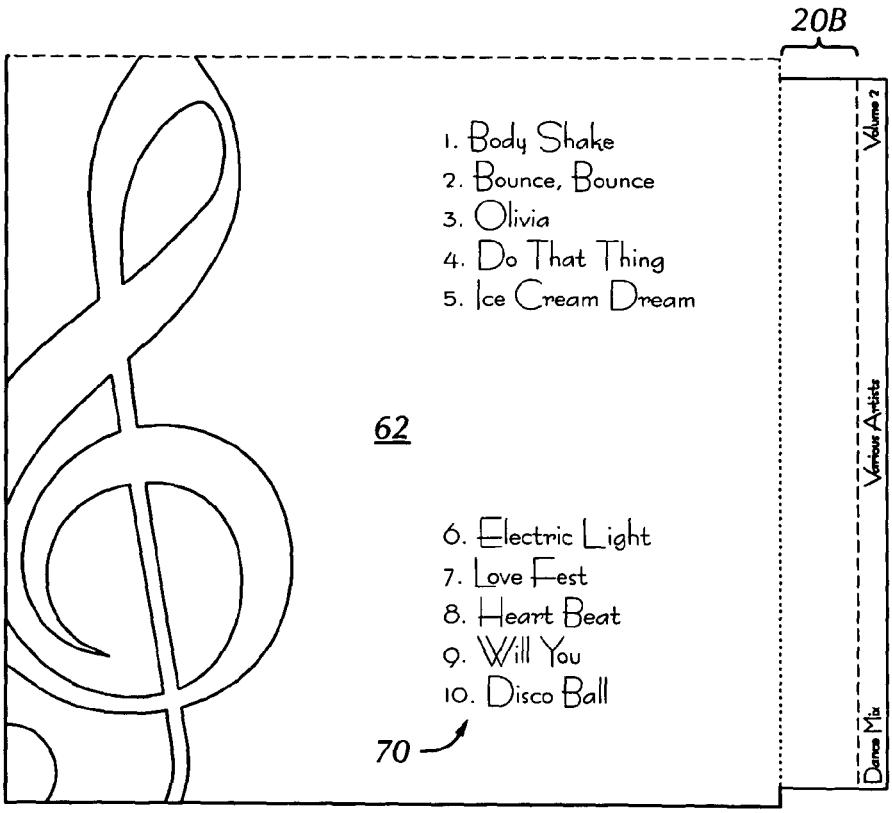

For example, the user may first print the front and/or back of the sheet 10. To form a booklet, the user would then separate the left hand margin portion 54 and the spine portion 20 from the areas 60 and 62. The user would also remove the right hand margin 56 from the booklet section 60 and 62, as well as the upper margin portion 64 and the lower margin portion 66. That then leaves a booklet portion having a line of weakness 44, and first and second section 60 and 62, respectively. FIG. 3 illustrates a booklet that is printed on the front 60 and the back 62. However, the user may also print on the opposite sides of the sheet such that portion 60 is printed on both the front and the back and/or portion 62 is printed on the front and back. After printing the booklet and removing the margin portions and the spine portion from the booklet to form the booklet shown in FIG. 3, the user then folds the booklet along line of weakness 44, which is preferably a cut-and-tie arrangement, but may alternatively be a score line, regular perforations, or other suitable type of line of weakness that may be folded but will not break upon folding. The printing is illustrated as text and/or graphics 68 and text and/or graphics 70. However, as mentioned above, the booklet may also be printed on the opposite side (not shown) of the booklet FIGS. 4A and 4B is an alternative end product that is formed from sheet 10 after printing. The product of FIGS. 4A and 4B includes the area 60 and the area 62 upon which have been printed text and/or graphics. Each of the portions 60 and 62 are connected to respective spine portions 20A and 20B. These sections 20A and 20B form a spine section for labeling the spine of a slim line CD case. The spine sections 20A and 20B may including printing such as graphics and/or indicia to form a printed spine.

To print and form the separate jewel case inserts with slim line spines, the user first prints both of the sections 60 and 62 in FIG. 1. The user may also print onto the slim line spine section 20, or a portion of the spine, such as the portion in between lines of weakness 14 and 16. After printing, the user separates the two inserts together with the respective spine portions from the remainder of the sheet. Thereafter, the user may separate the two inserts along the line of weakness 44. One way of doing so is to fold the two sections along line of weakness 44 several times. Then the user may easily separate the sections to form two separate inserts. The user then may remove the portions 22, 24, 26 and 28 to form the inserts with respective spine portions 20A and 20B, as illustrated in FIG. 4. The user may optionally fold the spine section 20 along the line of weakness 16 so as to form a crease in the spine section 20.

Figure 5A:
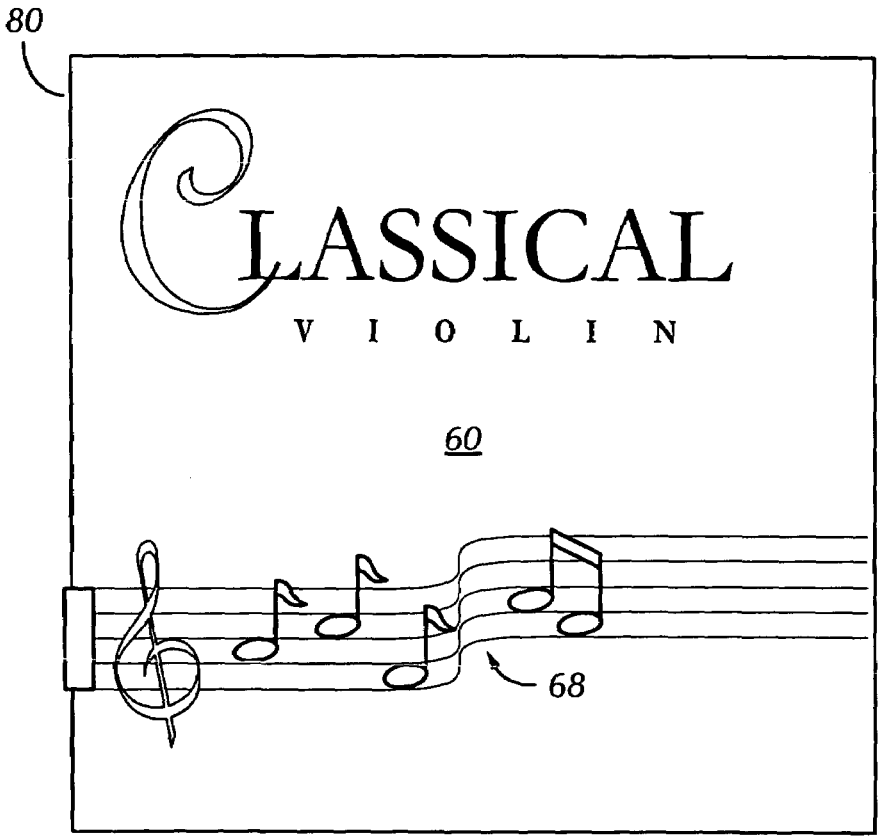
FIGS. 5A and 5B illustrates two inserts that can be inserted into a regular size compact disc case, this embodiment having no spine portion, and being formed using the sheets of FIG. 1 or 2.
Figure 5B:
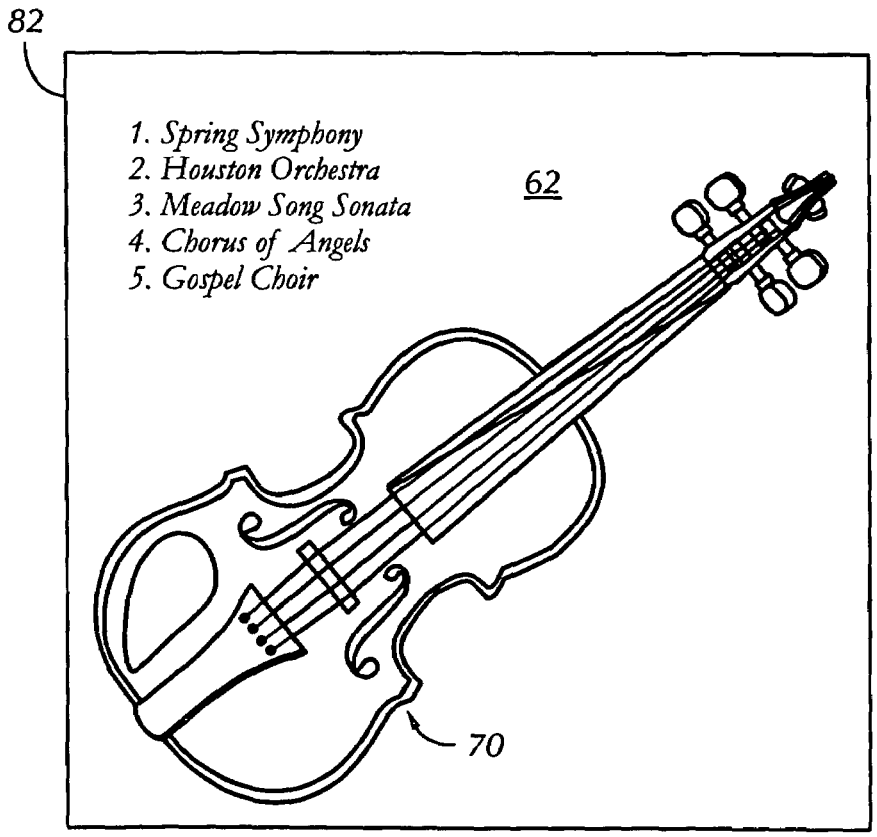

FIGS. 5A and 5B illustrates yet a further alternative end product formed from the sheet of FIG. 1. In FIGS. 5A and 5B are shown two separate CD jewel case inserts 80 and 82 respectively. Section 80 consists of the jewel case insert section 60 whereas insert 82 consists of the jewel case insert portion 62. There is no spine portion on either of inserts 80 and 82. The sections 80 and 82 may be printed with text and/or graphics 68 and 70 respectively.

To form the inserts 80 and 82, from the sheet 10 of FIG. 1, the user first prints on printable areas 60 and 62, and may also print on the back sides of portions 60 and 62 (not shown) to form an insert having printing on two sides. The user then removes sections 54, 20 and 56 from the insert sections, then removes the top and bottom sections 64 and 66, although the user might separate section 64 and 66 first, and then section 54, 20 and 56, or in any other order. The user is then left with the booklet sections 60 and 62 joined along line of weakness 44. The user may then fold back and forth along line of weakness 44 and then separate the two sections 80 and 82. Upon completion, the user may then insert sections 80 and 82 (FIG. 5) into the front or back of the respective jewel cases. Sections 80 and 82 are typically formed to be inserted into the front portion of the CD jewel case. However, in some instances, the inserts 80 and 82 may be inserted into the back portion of the jewel case to serve as a rear jewel case insert.

Figure 2:
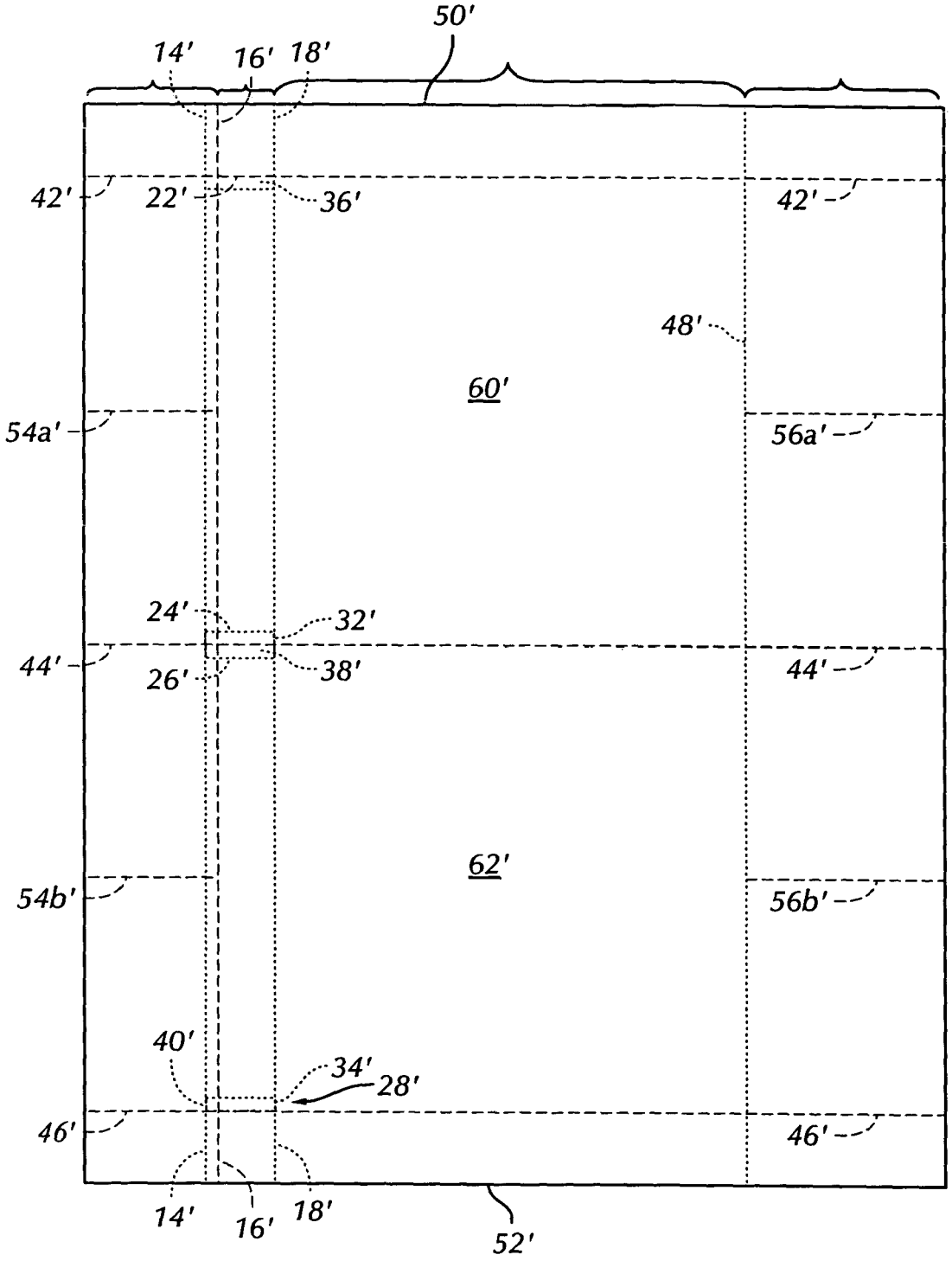
FIG. 2 is similar to the arrangement in FIG. 1, except that the sheet in FIG. 2 is not printed with instructions.

Considering one alternative embodiment of the sheet 10 in FIG. 1, the sheet 10' of FIG. 2 may be constructed in a manner similar to the embodiment of FIG. 1, but without preprinted indicia such as the instructions 58. While the embodiment illustrated in FIG. 2 has no indicia at all, other embodiments may include basic information such as a trademark and a product number, which can also be a trademark. The sheet 10' in FIG. 2 may alternatively include other information such as a customer service phone number and/or an internet address. A further alternative is to include instructions for printing, but not instructions for how to form the inserts, inserts with spines for slim line cases and/or for forming a booklet. In fact, the sheet may include whatever indicia the manufacturer wishes to include. Also, the small sections 22, 24, 26 and 28 in FIG. 1 need not be shaded, as illustrated in FIG. 2. The various reference numbers in FIG. 2 correspond to the same reference numbers in FIG. 1, although a prime has been added in superscript to each of the reference numbers in FIG. 1.

The user may use any of a number of different graphics, word processing, or other software to define the section that is to be printed on sheet 10 (FIG. 1). However, a preferred embodiment of software includes templates that specifically correlate to printing a booklet, printing a jewel case insert, or printing a jewel case insert with a slim line spine. For example, a single computer program that allows the user to specify what type of booklet or insert he or she wants to create, then accepts data from the user as to what indicia and/or graphics he or she wants to print on the end product. The software may optionally allow the user to specify exactly what location or locations the user wishes to print on. For example, the user may wish to put graphics in the upper left hand corner of section 60 with text and/or graphics in the lower right hand corner of section 60, but otherwise leave the rest of the portion 60 blank. There are hundreds of different combinations of text and/or graphics and the locations on the front and/or back of section 60 and 62 where the text and/or graphics are to be printed. The software can permit the user to place text and/or graphics at any location on the booklet or insert that is the end product. Alternatively, the software may permit the user to place text and/or graphics only at specific locations, such as by having preformatted templates that define a particular text font, color scheme, and/or locations of where the text and/or graphics may be placed. The software may optionally include predetermined color schemes for the entire face or faces of the printed section 60 and 62 or may predefine any of a number of other customizable aspects of the end product. Of course, when the end product is an insert having a spine portion for use in a slim line or other jewel case, the templates may be provided and allow the user to further print text and/or graphics along the spine section 20, as desired.

Such software may reside in any of a number of locations. For example, the software may reside on a stand alone office-based computer, a portable notebook computer, a personal data assistant (PDA), a cell phone, or any device having sufficient processing and memory resources to run the software, or to interface with another device that does have sufficient computing resources, and to allow the user to input data required for forming the booklet or insert. These stand alone computers may also be able to cause a printer to print onto the sheet 10 of FIG. 1 or the sheet 10' in FIG. 2. The printer may be, for example, a home/office printer, such as a laser printer or ink jet printer or other type of printer that is typically used in a home or office environment. The connection between the stand alone computer and the printer may take the form of a cable running in between the computer and the printer, or may take the form of a wireless digital or optical connection between the computer and printer, or in the case of several computers printing to one particular printer, there may be an intermediary computer such as a printer server, or other intermediary storage or computing device.

In the case of a computer network, the software may be stored on a server that is in communication with various stand alone computing devices, or that is in communication with another server. The local computer then serves primarily as a means for users to input information about the end product and/or the design of the end product, a specification as to which template to use, or various other user input information. The server may, for example, display on the local computer a user interface, comprising one or more screens requesting particular information from the user. For instance, the display screen or screens may request specification of the particular end product to be made with the sheet 10 or 10' of FIGS. 1 and 2, respectively. The display screens may also display a visual representation of the end product (a booklet, an insert or an insert with a spine portion), and/or allow the user to specify which of the graphical representations corresponds to the end product that the user wishes to create. The display screens may include further information about the sheets, such as instructions for use and/or printing onto the sheets.

It should be noted that when the system is used in a network environment, the server may take the user input data and generate a graphical representation of what the user has designed, for the user's approval prior to printing. In an alternative approach, the server forms a graphics file, such as a PDF file and transmits it back to the local computer. The local computer then takes the PDF or other graphic file, optionally displays the file for the user's review and/or amendment, and ultimately prints the file on a printer. Consequently, the bulk of processing occurs on the server rather on the local computer. This can save some time, in some instances, such as when the server has substantially more memory and/or computer power than the local printer.

It should also be noted that the server need not send the graphic file back to the local computer, but may send it to another server, to another client computer, or directly to a printer that is interconnected to the server, or to a client that is different from the client at which the user defines a format and data about the end product, or may transmit the file by e-mail or FTP to a commercial printing facility, such as in the case where a large number of the inserts or booklets are to be printed.

The ability to create such software resides within the skill of a professional computer programmer who has experience with programs for printing onto media, and/or experience in working with client-server arrangements, if a client-server model is to be used. Regarding various alternative aspects of the sheet, the sheet may be coded on one or both sides with a special coating to receive either ink jet ink-receptive surface, or to form a surface receptive to printing from a laser printer. Ink jet ink-receptive coatings and laser printing-receptive coatings are well-known in the art. The coatings may have a glossy finish or a matte finish. Alternatively, the sheet may be uncoated on one side or both sides. As a further alternative, one side of the sheet may be coated with a glossy or semi-glossy finish, whereas the other side is coated with a matte finish. Or, one side may be coated with a gloss or matte finish, whereas the other side is uncoated or is coated with the same type of coating as is used on the other surface. Consequently, various combinations of coating or coatings and/or uncoated portions may be implemented. Such coatings, considered alone, are conventional in the prior art.

As a further alternative the pattern of FIG. 1 may be adapted to be placed in landscape mode, such that the pattern shown in FIG. 1 is not printed along the length of the sheet, but is printed along the narrow direction of a sheet. As a further alternative, the pattern shown in FIG. 1 may be printed on a web such that a number of such patterns are formed on a single web, then are separated into individual sheets. In the case of very small jewel cases, such as jewel cases for accommodating small sized compact discs, the pattern of FIG. 1 may be reduced in size in order to form a booklet or inserts that correspond in size to the small sized jewel case.

It is further noted that the term home/office printer may include not only ink jet and laser printers but other types of printers, such as thermal printers, die transfer printers, plotters, dot matrix printers, color laser printers, and/or other printers that are suitable for use in a home or office environment. Alternatively, a commercial printing facility may be used to print the end products, using a press or other printing means that are standard in the commercial printing environment.

It is further possible to provide removable sections defined by lines of weakness on the insert or booklet. For example, in a booklet it may be desirable to include in a portion of the booklet having a removable coupon or a form for the end user to fill out and return to the manufacturer or distributor. Such removable portions will typically be formed in the sheet defining the back of the booklet, so that the removed portion is not visible from the front of the case. The removable portion would typically be defined by lines of weakness, preferably microperforations, but alternatively by cut-and-tie arrangements, regular perforations, microperforations, and/or die cuts.

In the case of compact discs for children, a printed booklet or the front and/or back side of an insert, may be printed with the outline of a character or figure, inside of which the end user may color or draw.

It should also be understood that the arrangement of FIG. 1 and FIG. 2 may be extended such that there are three main principle portions rather than just printable portions 60 and 62 and an addition spine section portion corresponding to the third primary section. That way, the user may form a fold out booklet having a total of six sides, rather than a booklet having a total of four sides as can be formed from FIGS. 1 or 2. Alternatively, more than three sections may be implemented as an alternative to the design of FIGS. 1 and 2. The sections may be printed on and then folded to form eight or more total sides in the fold out arrangement. Or, the multiple sections may each define a stand alone insert, with or without corresponding spine portions.

As a further embodiment, a sheet may be formed having just one section, such as section 60, and then related spine portion and/or margin portions such as portions 64, 66, 54, and/or 56. A margin portion 66 would typically be located next to line 44. Lines of weakness 42 and 44 may be formed with microperforations. This embodiment would be selectively printing and forming an insert with or without a spine portion.

As far as dimensions, one embodiment of the sheet of FIG. 1 has overall dimensions of 8 ½"×11". The longitudinal measurements are: between line of weakness 14 and the left hand side of the sheet: 1 3/16"; between line of weakness 14 and 16: ⅛"; between lines 16 and 18—9/16"; between lines 18 and 48: 4⅝"; between line 48 and the right hand edge: 1⅞".

Consequently, it is readily apparent that the present invention includes a wide variety of additional and/or alternative features. Thus, the present invention is not limited to the specific preferred embodiments discussed above, but also include whatever else is defined in the following claim section.

What is claimed is:

1. A versatile sheet from which a jewel case booklet, jewel case insert or jewel case insert with a spine section may be selectively printed and formed, comprising:

a printable generally rectangular sheet suitable for printing in laser and inkjet printers, said sheet having a first longitudinal line of weakness;

said sheet having a second longitudinal line of weakness, spaced apart from said first longitudinal line of weakness;

said sheet having a third longitudinal line of weakness, spaced apart from said second longitudinal line of weakness;

said first, second and third lines of weakness together defining a printable jewel case spine portion;

said sheet having upper, central and lower latitudinal lines of weakness;

said sheet having a fourth longitudinal line of weakness extending the length of the sheet, said fourth line of weakness being spaced from said third longitudinal line of weakness;

wherein said third and fourth longitudinal lines of weakness and said upper, central and lower latitudinal lines of weakness define printable jewel case booklet sections; and wherein the versatile sheet may be selectively separated along lines of weakness to form any of a jewel case booklet, a jewel case insert and a jewel case insert with a spine section, as desired by the user.

2. A sheet as defined in claim 1, wherein the sheet has dimensions of approximately 8 ½ inches wide by 11 inches long.

3. A sheet as defined in claim 1, wherein the sheet includes printed instructions for forming a jewel case booklet, a jewel case insert, and a jewel case insert with spine portion.

4. A sheet as defined in claim 3, wherein the sheet has a booklet/insert section, outer perforations, and a spine section, and the instructions instruct the user:

to form a booklet, separate a booklet/insert section along perforations and fold in half to farm a booklet;

to form a jewel case insert, separate a booklet/insert section along perforations and separate in half;

to form two jewel case inserts, separate along outer perforations, separate in half, and fold once along a spine section.

5. A method of using a computer, computer software and a printer to custom print and form a versatile, printable sheet for selectively forming a booklet, a jewel case insert with a spine portion, or a jewel case insert with no spine portion, all for mounting within a case for holding a disc, such as for example a cd or dvd, comprising the steps of providing a sheet as defined in claim 1 to one of a laser and inkjet printer;

specifying to the computer software which of the booklet, insert with a spine portion, and insert with no spine portion is to be formed from the sheet;

designing at least one of text and graphics to be printed on the sheet;

printing at least one of text and graphics onto the sheet;

separating portions of the sheet from other portions of the sheet, the sections that are to be separated from one another being determined by whether a booklet, an insert or an insert with a spine portion is to be formed.

6. A method as defined in claim 5, wherein the method further comprises the step of displaying at least one of a visual representation of a booklet, a jewel case insert, and a jewel case insert with a spine portion.

7. A method as defined in claim 5, wherein the method further comprises the step of providing at least one of text and graphics onto a template corresponding to a booklet an insert or an insert with a spine section that is to be formed.

8. A sheet as defined in claim 1, wherein said first, third and fourth longitudinal lines of weakness comprise microperforations.

9. A sheet as defined in claim 1, wherein the spine section has top and bottom portions, said spine section having removable sections at the top and bottom of the spine section.

10. A sheet as defined in claim 9, wherein the removable sections are microperforated.

* * * * *